US011393377B2

(12) United States Patent
Fujikawa

(10) Patent No.: US 11,393,377 B2
(45) Date of Patent: Jul. 19, 2022

(54) ELECTRO-OPTICAL DEVICE, AND ELECTRONIC APPARATUS

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/230,493

(22) Filed: Apr. 14, 2021

(65) Prior Publication Data

US 2021/0327327 A1 Oct. 21, 2021

(30) Foreign Application Priority Data

Apr. 15, 2020 (JP) ..... JP2020-072728

(51) Int. Cl.
*G09G 3/20* (2006.01)

(52) U.S. Cl.
CPC ..... *G09G 3/20* (2013.01); *G09G 2310/0267* (2013.01); *G09G 2310/0294* (2013.01)

(58) Field of Classification Search
CPC ..... G09G 3/20; G09G 2310/0267; G09G 2310/0294
See application file for complete search history.

(56) References Cited

U.S. PATENT DOCUMENTS

| | | | | |
|---|---|---|---|---|
| 9,508,780 | B2 * | 11/2016 | Tanikame | H01L 27/1255 |
| 9,955,097 | B2 * | 4/2018 | Iwabuchi | H01L 27/14636 |
| 10,089,921 | B2 * | 10/2018 | Chaji | G09G 3/3225 |
| 2005/0269959 | A1 * | 12/2005 | Uchino | G09G 3/3233 315/169.3 |
| 2012/0249616 | A1 | 10/2012 | Komatsu et al. | |
| 2018/0158431 | A1 | 6/2018 | Fujikawa | |
| 2019/0362689 | A1 | 11/2019 | Fujikawa | |
| 2020/0005726 | A1 | 1/2020 | Fujikawa | |

FOREIGN PATENT DOCUMENTS

| | | | |
|---|---|---|---|
| JP | 2004-361427 | A | 12/2004 |
| JP | 2011-186282 | A | 9/2011 |
| JP | 2012-208389 | A | 10/2012 |
| JP | 2018-92140 | A | 6/2018 |
| JP | 2019-207398 | A | 12/2019 |

* cited by examiner

*Primary Examiner* — Sejoon Ahn
(74) *Attorney, Agent, or Firm* — Oliff PLC

(57) ABSTRACT

An electro-optical device is provided that includes a pixel circuit disposed corresponding to each of intersections of a scanning line and eight signal lines, an image signal circuit, and a control circuit. The image signal circuit includes a write switch provided for each of the eight signal lines, and in a horizontal scanning period, an image signal is sequentially supplied to the eight signal lines in eight supply periods based on selection signals sequentially selecting eight writing switches. The control circuit controls the selection signals so that a time length of a supply period at a positive polarity time of an image signal is longer than a time length of a supply period at a negative polarity time.

6 Claims, 12 Drawing Sheets

ELECTRO-OPTICAL DEVICE, AND ELECTRONIC APPARATUS

The present application is based on, and claims priority from JP Application Serial Number 2020-072728, filed Apr. 15, 2020, the disclosure of which is hereby incorporated by reference herein in its entirety.

BACKGROUND

1. Technical Field

The present disclosure relates to an electro-optical device and an electronic apparatus.

2. Related Art

An electro-optical device that displays an image using a liquid crystal element supplies a video voltage based on an image signal specifying a gradation of each pixel to each pixel circuit via a signal line, to control such that a transmittance of the liquid crystal contained in each pixel circuit is set to a transmittance based on the video voltage. As a result, the gradation of each pixel is set to the gradation specified by the image signal. JP 2018-92140 A describes that pre-charge is performed to avoid a reduction in display quality due to lack of writing of a video voltage to a pixel circuit. Additionally, JP 2018-92140 A describes that a pre-charge voltage is different for a negative polarity case and for a positive polarity case, when polarity inversion driving is performed in which a polarity of a pixel signal is reversed every constant period in order to prevent electrical degradation of an electro-optical material such as liquid crystal.

In an electro-optical device in which the polarity inversion driving is performed, it is difficult to secure a writing time to a signal line due to high definition, and display unevenness caused by the polarity of the image signal may occur in a driving method in the past. Specifically, when an N-channel type transistor is used as a sampling switch for selecting a signal line, a writing time to the signal line for positive polarity time display in common potential fixed drive is insufficient, and display unevenness caused by insufficient writing may occur.

SUMMARY

In order to solve the above problem, an aspect of an electro-optical device of the present disclosure includes a scanning line, K signal lines, a pixel circuit disposed corresponding to each of intersection of the scanning line and the K signal lines, an image signal circuit including a sampling switch provided for each of the K signal lines, and configured to sequentially supply an image signal to the K signal lines, in K supply periods based on K selection signals for sequentially selecting the K sampling switches, in a horizontal scanning period, and a control circuit configured to control the K selection signals such that a length of at least one supply period of the K supply periods in the horizontal scanning period changes in accordance with a polarity of the image signal. However, K is an integer equal to or greater than 2.

In addition, in order to solve the above problem, an aspect of an electro-optical device of the present disclosure includes a scanning line, K signal lines, a pixel circuit disposed corresponding to each of intersection of the scanning line and the K signal lines, an image signal circuit including a sampling switch provided for each of the K signal lines, and configured to sequentially supply an image signal to the K signal lines, in K supply periods based on K selection signals for sequentially selecting the K sampling switches, in a horizontal scanning period, and a control circuit configured to control the K selection signals such that start timing of a first supply period of the K supply periods in the horizontal scanning period changes in accordance with a polarity of the image signal. In the present aspect as well, K is an integer equal to or greater than 2.

DESCRIPTION OF EXEMPLARY EMBODIMENTS

Exemplary embodiments of the present disclosure will now be described with reference to the accompanying drawings. The exemplary embodiments described below are subject to various technically preferred limitations. However, the exemplary embodiments of the present disclosure are not limited to the following embodiments detailed below.

First Exemplary Embodiment

Figure 1:
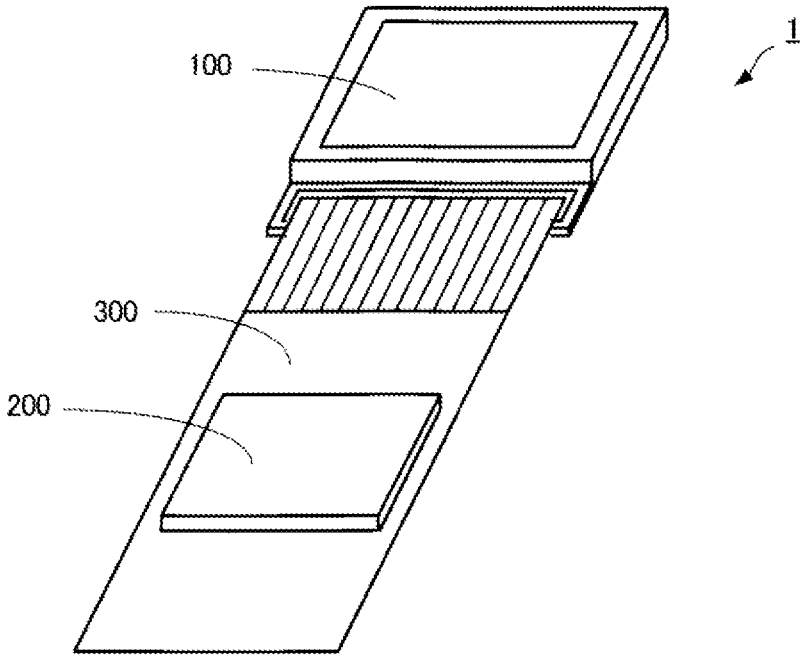
FIG. 1 is an explanatory diagram of an electro-optical device according to a first exemplary embodiment of the present disclosure.

FIG. 1 is an explanatory diagram of an electro-optical device 1 according to a first exemplary embodiment of the present disclosure. The electro-optical device 1 is a demultiplex-driven electro-optical device. FIG. 1 illustrates a configuration of a signal transmission system for the electro-optical device 1. The electro-optical device 1 includes an electro-optical panel 100, a drive integrated circuit 200 such as a driver IC (Integrated Circuit), and a flexible printed wired board 300.

The electro-optical panel 100 is coupled to the flexible printed wired board 300 on which the drive integrated circuit 200 is mounted. Further, the electro-optical panel 100 is coupled to a host CPU (Central Processing Unit) device not illustrated via the flexible printed wired board 300 and the drive integrated circuit 200. The drive integrated circuit 200 is a device that receives an image signal and various control signals for drive control from the host CPU device via the flexible printed wired board 300, and drives the electro-optical panel 100 via the flexible printed wired board 300.

The electro-optical device 1 displays an image using a liquid crystal element. For example, the electro-optical device 1 supplies a video voltage based on an image signal specifying a gradation of each pixel to a pixel circuit corresponding to the pixel, to control such that a transmittance of liquid crystal contained in each pixel circuit is set to a transmittance based on the video voltage. As a result, the gradation of each pixel is set to the gradation specified by the image signal. Note that, in the electro-optical device 1, in order to prevent electrical degradation of an electro-optical material, polarity inversion driving is employed in which a polarity of a voltage applied to the liquid crystal element is inverted every constant period. For example, the electro-optical device 1 inverts a level of an image signal supplied to a pixel circuit for each one vertical scanning period with respect to a center voltage of the image signal. Note that a period for inverting polarity can be arbitrarily set, and for example, may be set to a natural number multiple of the vertical scanning period. In the present specification, a polarity when a voltage of an image signal is positive with respect to common potential is referred to as a positive polarity, and a polarity when the voltage of the image signal is negative with respect to the common potential is referred to as a negative polarity.

Figure 2:
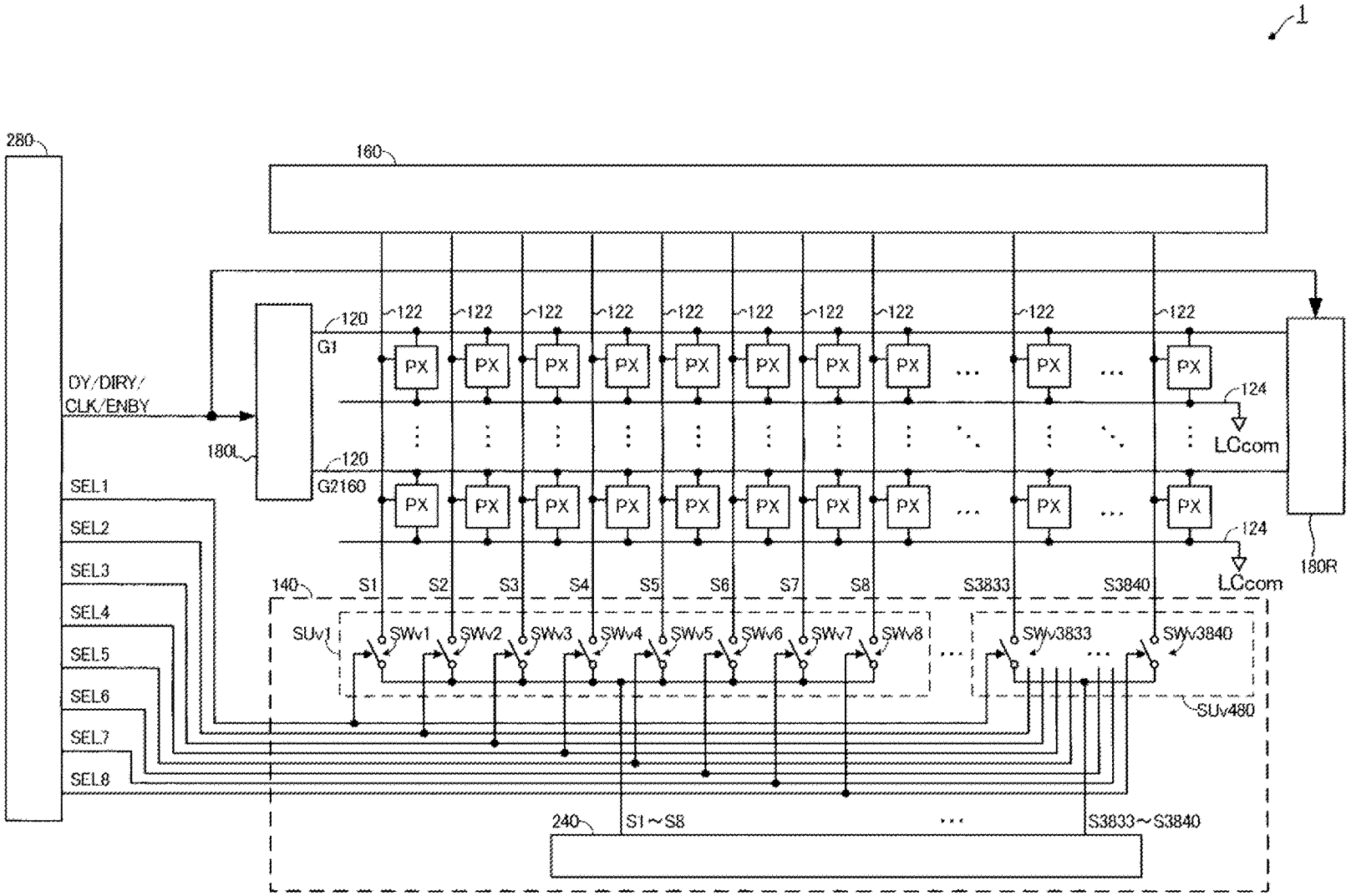
FIG. 2 is a block diagram illustrating a configuration of the electro-optical device according to the first exemplary embodiment.

FIG. 2 is a block diagram illustrating a configuration of the electro-optical device 1 according to the first exemplary embodiment. The electro-optical device 1 includes N scanning lines 120, M signal lines 122, a capacitance line 124 provided with common potential LCcom, N×M pixel circuits PX, an image signal circuit 140, an inspection circuit 160, a first scanning line drive circuit 180R, a second scanning line drive circuit 180L, and a control circuit 280. Note that, N and M are both integers of 2 or greater, and in the present exemplary embodiment, N is 2160 and M is 3840. The inspection circuit 160 includes a selection circuit (not illustrated), a plurality of inspection signal lines, and a plurality of inspection switches. The selection circuit controls the inspection switches. The inspection switch electrically couples the inspection signal line and the signal line 122, and performs conduction inspection/breaking inspection of the signal line 122 in the electro-optical panel 100, defect determination of the pixel circuit PX, or the like. Except at the time of the inspection, the inspection switch is forcibly turned off, and the inspection circuit 160 and the signal line 122 are electrically separated. Of blocks illustrated in FIG. 2, the control circuit 280 and a signal line driving circuit 240 described later, are included in the drive integrated circuit 200. In addition, of the blocks illustrated in FIG. 2, blocks other than the control circuit 280 and the signal line driving circuit 240 are included in the electro-optical panel 100.

The M signal lines 122 are classified, for example, into signal line groups each including K signal lines 122. However, K is an integer equal to or greater than 2. In the example illustrated in FIG. 2, K is 8. Accordingly, the 3840 signal lines 122 are classified into 480 signal line groups, each including eight signal lines 122. Note that, K is not limited to 8 as long as K is an integer of 2 or greater. Moreover, the total number of signal lines 122 is not limited to 3840. For example, the total number of signal lines 122 may be K. In this case, the number of the signal line groups is 1.

A scanning signal G is supplied to each of the N scanning lines 120, and an image signal S or a pre-charge signal PRC is supplied to the signal line 122. A number at an end of a reference sign of the scanning signal G corresponds to a row number. Furthermore, a number at an end of a reference sign of each of the image signal S and a write switch SWv described later corresponds to a column number. The common potential LCcom is supplied to the capacitance line 124. In the present exemplary embodiment, the common potential LCcom is 7V.

Each of the N×M pixel circuits PX is disposed corresponding to each of intersections of the N scanning lines 120 and the M signal lines 122. In the example illustrated in FIG. 2, the pixel circuits PX are disposed in a matrix of vertical 2160 rows and horizontal 3840 columns. Note that, the number of pixel circuits PX is not limited to the example illustrated in FIG. 2. In FIG. 2, a row of the pixel circuits PX illustrated on a topmost side of the figure is a first row, and a column of the pixel circuits PX illustrated on a leftmost side of the figure is a first column. In addition, in the following, the scanning line 120 coupled to the pixel circuits PX in an n-th row is also referred to as the scanning line 120 in the n-th row, and the signal line 122 coupled to the pixel circuits PX in an m-th column is also referred to as the signal line 122 in the m-th column. Note that, in the example illustrated in FIG. 2, n is an integer from 1 to 2160, and m is an integer from 1 to 3840.

Figure 3:
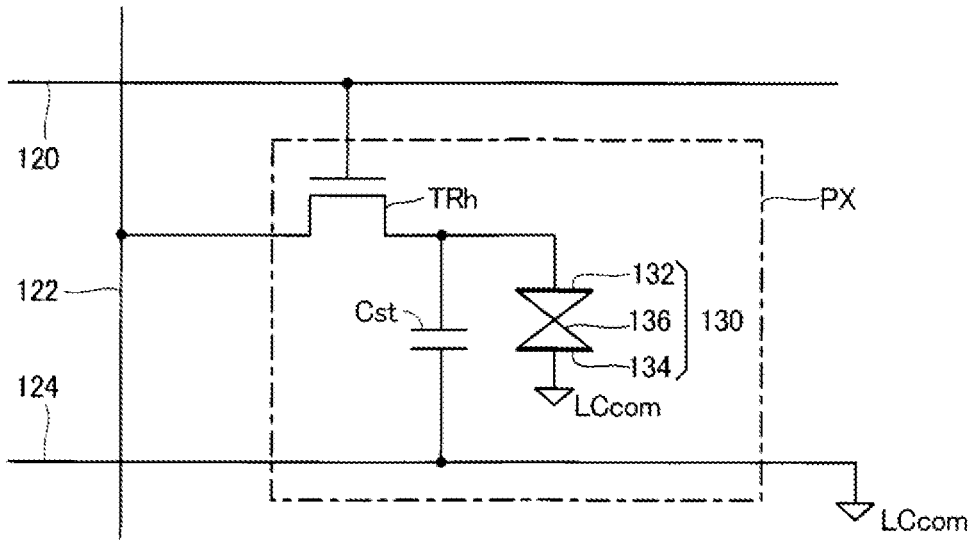
FIG. 3 is a circuit diagram illustrating a configuration of a pixel circuit.

FIG. 3 is a circuit diagram illustrating a configuration of the pixel circuit PX. Each pixel circuit PX includes a liquid crystal element 130, a retention capacitor Cst coupled to the capacitance line 124, and a pixel transistor TRh. The liquid crystal element 130 is an electro-optical element including a pixel electrode 132 and a common electrode 134 that face each other, and liquid crystal 136 disposed between the pixel electrode 132 and the common electrode 134. A display gradation changes due to a change in transmittance of the liquid crystal 136 in accordance with an applied voltage between the pixel electrode 132 and the common electrode 134. Note that, the common potential LCcom that is a constant voltage is supplied to the common electrode 134 via a common line (not illustrated).

The retention capacitor Cst is provided in parallel with the liquid crystal element 130. One terminal of the retention capacitor Cst is coupled to the pixel transistor TRh, and another terminal is coupled to the common electrode 134 via the capacitance line 124.

The pixel transistor TRh is, for example, an N-channel type transistor constituted by a TFT or the like. The pixel transistor TRh is provided between the liquid crystal element 130 and the signal line 122. Then, the pixel transistor TRh is set to either a conductive state or a non-conductive state in accordance with a level of the scanning signal G supplied to the scanning line 120 coupled to a gate. In other words, the pixel transistor TRh controls electrical coupling between the liquid crystal element 130 and the signal line 122. For example, setting a scanning signal Gm to selective potential allows the respective pixel transistors TRh in the pixel circuits PX in the m-th row to transit to the conductive state simultaneously or substantially simultaneously.

When the pixel transistor TRh is controlled to be set to the conductive state, a video voltage based on the image signal S supplied from the signal line 122 is applied to the liquid crystal element 130. The liquid crystal 136 is set to a transmittance based on the image signal S by being applied with the video voltage based on the image signal S. Further, when a light source (not illustrated) is turned on, light emitted from the light source passes through the liquid crystal 136 of the liquid crystal element 130 included in the pixel circuit PX and is outputted to an outside of the electro-optical device 1. In other words, when the video voltage based on the image signal S is applied to the liquid crystal element 130, and the light source is turned on, the pixel circuit PX displays a gradation based on the image signal S. The retention capacitor Cst provided in parallel with the liquid crystal element 130 is charged to the video voltage applied to the liquid crystal element 130. In other words, each pixel circuit PX retains a voltage corresponding to the image signal S in the retention capacitor Cst.

In a horizontal scanning period, the image signal circuit 140, in eight supply periods based on eight selection signals SEL1 to SEL8 that sequentially select eight signal lines 122 included in each signal line group, sequentially supplies the image signal S to each of the eight signal lines 122. Note that, in the description below, the selection signals SEL1 to SEL8 are generalized and also referred to as selection signals SEL. The horizontal scanning period is a period for writing the video voltage based on the image signal S supplied to the signal lines 122 in each column to the pixel circuits PX in one row. The row to be written is selected by the scanning signal G supplied to the scanning line 120 from the first scanning line drive circuit 180R and the second scanning line drive circuit 180L.

The image signal circuit 140 includes a plurality of write selection circuits SUv provided respectively corresponding to a plurality of signal line groups, and the signal line driving circuit 240 that outputs the image signal S to each write selection circuit SUv. For example, a write selection circuit SUv1 corresponds to a signal line group including eight signal lines 122 in from a first column to an eighth column, and selects the signal line 122 to be supplied with the image signal S from the eight signal lines 122 in from the first column to the eighth column. Further, a write selection circuit SUv480 corresponds to a signal line group including eight signal lines 122 in from a 3833-th column to a 3840-th column, and selects the signal line 122 to be supplied with the image signal S from the eight signal lines 122 in from the 3833-th column to the 3840-th column.

Each write selection circuit SUv has K write switches SWv respectively coupled to eight signal lines 122 included in a corresponding signal line group, that is, K signal lines 122. The write switch SWv is an N-channel type transistor constituted by, for example, a TFT (thin film transistor) or the like. The write switch SWv is an example of a sample switch in the present disclosure. That is, the image signal circuit 140 includes K sample switches provided respective K signal lines 122 included in one signal group. The write switch SWv is set to either the conductive state or the non-conductive state in accordance with a level of the selection signal SEL received by a control terminal such as a gate. Note that, the write switch SWv may be a P-channel type transistor, or a switching element other than a TFT. Configurations of the respective write selection circuits SUv are identical to each other, except that a coupling destination of a terminal other than a control terminal of the write switch SWv is different for each write selection circuit SUv. For this reason, a description will be given below of a configuration of the write selection circuit SUv1.

For example, the write selection circuit SUv1 has eight write switches SWv1 to SWv8. One ends of the respective write switches SWv1 to SWv8 are coupled to eight signal lines 122 in from the first column to the eighth column, respectively. Further, another ends of the respective write switches SWv1 to SWv8 are coupled to each other, and receive image signals S1 to S8 sequentially from the signal line driving circuit 240. Then, in accordance with control by the control circuit 280 described below, of the write switches SWv1 to SWv8, the write switches SWv to be set to the conductive state are sequentially switched in one horizontal scanning period. As a result, the image signals S1 to S8 outputted sequentially from the signal line driving circuit 240 are sequentially supplied to corresponding signal lines 122.

For example, when the selection signal SEL1 is set to selective potential such as a high level, the write switch SWv1 that receives the selection signal SEL1 transits to the conductive state. As a result, the image signal S1 is supplied from the signal line driving circuit 240 to the signal line 122 in the first column, and the signal line 122 in the first column is charged to a video voltage based on the image signal S1. Note that, the selection signal SEL1 is also supplied to the write switches SWv in an identical sequence to that of the write switch SWv1, for example, a write switch SWv3833, in each write selection circuit SUv other than the write selection circuit SUv1.

In the example illustrated in FIG. 2, the write switches SWv mutually having an identical value as a remainder of a division of a number at an end of a reference sign of each write switch SWv by 8 are the write switches SWv in an identical sequence, and each receive a common selection signal SEL by a control terminal. For example, the write switch SWv1 is in an identical sequence to that of the write switch SWv3833, and the write switch SWv8 is in an identical sequence to that of the write switch SWv3840.

In the following, the write switches SWv controlled by a selection signal SELk are also referred to as the write switches SWv in a k-th sequence. Note that, k is an integer from 1 to 8, that is, an integer from 1 to K. Further, the signal line 122 coupled to the write switch SWv in the k-th sequence is also referred to as the signal line 122 in the k-th sequence. Accordingly, a number at an end of a reference sign of the selection signal SEL corresponds to a sequence number of the signal line 122 to be controlled.

The signal line driving circuit 240 outputs the image signal S for eight pixels, that is, the image signal S for K pixels, as a time-series serial signal to each write selection circuit SUv. For example, the signal line driving circuit 240 sequentially outputs the image signals S1 to S8 to the write selection circuit SUv1, and sequentially outputs image signals S3833 to S3840 to the write selection circuit SUv480. The image signal S supplied to the signal lines 122 in an identical sequence is outputted from the signal line driving circuit 240 in parallel to each write selection circuit SUv. In other words, the signal line driving circuit 240 outputs each image signal S supplied to the signal lines 122 in an identical sequence in parallel to each of a plurality of signal line groups.

The signal line driving circuit 240 supplies the pre-charge signal PRC before supplying the image signal S from the image signal circuit 140 to the K signal lines 122 included in each signal line group, in a horizontal scanning period. As a result, the signal line 122 before being supplied with the image signal S is charged to a predetermined pre-charge voltage based on the pre-charge signal PRC. The signal line driving circuit 240 supplies a pre-charge voltage based on a polarity of the image signal S to the signal line 122 based on a set value stored in an external set value storage means (not illustrated), or the like. For example, when a pre-charge voltage at a positive polarity time is VPCG+, and a pre-charge voltage at a negative polarity time is VPCG−, VPCG+ is 4V, and VPCG− is 2V in the present exemplary embodiment. The reason why the pre-charge voltage VPCG+ at the positive polarity time and the pre-charge voltage VPCG− at the negative polarity time differ is that a voltage range of an image signal varies depending on a polarity of the image signal, and thus an optimal pre-charge voltage varies.

Figure 4:
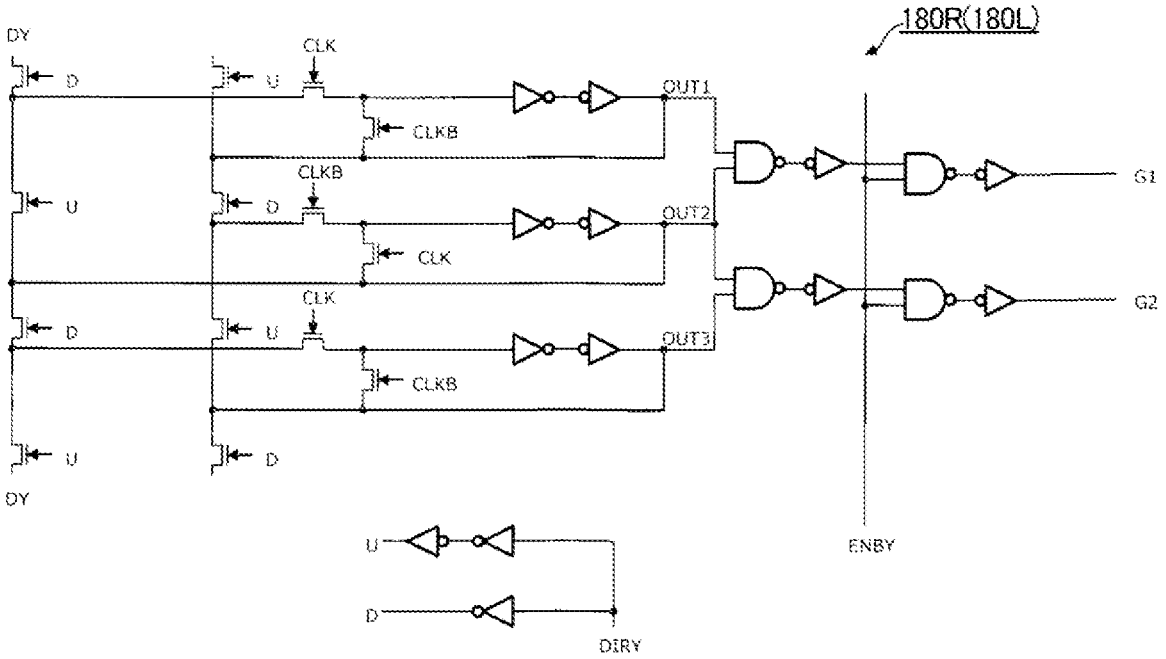
FIG. 4 is a diagram illustrating a configuration example of a scanning line drive circuit.

One ends of the N scanning lines 120 are coupled to the first scanning line drive circuit 180R, and another ends are coupled to the second scanning line drive circuit 180L, respectively. The first scanning line drive circuit 180R and the second scanning line drive circuit 180L output the scanning signal G for selecting a row to be supplied with an image signal in accordance with a start pulse signal DY, a clock signal CLK, a scanning direction signal DIRY, and an enable signal ENBY provided by the control circuit 280. For example, the first scanning line drive circuit 180R and the second scanning line drive circuit 180L transit potential of a scanning signal G1 to selective potential such as a high level in a first horizontal scanning period in which a video voltage is written to the pixel circuit PX in the first row. As the first scanning line drive circuit 180R and the second scanning line drive circuit 180L, as in the past, for example, a circuit illustrated in FIG. 4 is used. Note that, in FIG. 4, in order to avoid complicating the figure, a configuration for the scanning lines 120 in the first row and the second row is illustrated. Furthermore, the signal CLKB in FIG. 4 is a signal obtained by logically inverting the clock signal CLK. According to the circuit illustrated in FIG. 4, when the scanning direction signal DIRY is at a low level, the scanning signal G corresponding to the enable signal ENBY is outputted in an order from a top to a bottom to a plurality of the scanning lines 120. Furthermore, when the scanning direction signal DIRY is at a high level, the scanning signal G corresponding to the enable signal ENBY is outputted in an order from the bottom to the top. In the present exemplary embodiment, as the drive circuits that sequentially select each of the N scanning lines 120, the first scanning line drive circuit 180R and the second scanning line drive circuit 180L are provided, however, the drive circuit may be implemented by any one of the scanning line drive circuits.

The control circuit 280 receives a vertical synchronization signal that defines a vertical scanning period, a horizontal synchronization signal that defines a horizontal scanning period, and the like from an external host CPU device (not illustrated). Then, the control circuit 280 synchronizes and controls the first scanning line drive circuit 180R, the second scanning line drive circuit 180L, and the image signal circuit 140, based on the signals received from the host CPU device.

For example, the control circuit 280 controls timing at which the image signal S is supplied to the eight signal lines 122 included in each signal line group, that is, the K signal lines 122, using the selection signals SEL1 to SEL8. The control circuit 280 outputs the selection signals SEL1 to SEL8 for selecting the signal lines 122 in a sequence to be supplied with the image signal S to the write switches SWv in each sequence. For example, when supplying the image signal S to the signal lines 122 in a first sequence, the control circuit 280 causes potential of the selection signal SEL1 to transit to selective potential. As a result, the write switches SWv in the first sequence transit to the conductive state, and the image signal S outputted from the signal line driving circuit 240 is supplied to the signal lines 122 in the first sequence.

Note that, the control circuit 280 adjusts a length of a supply period of the image signal S to the signal lines 122 in each sequence, by adjusting a period in which the selection signal SEL is maintained at the selective potential. That is, in the horizontal scanning period, the control circuit 280 controls respective lengths of K supply periods in which the image signal S is supplied sequentially to the K signal lines 122 included in each signal line group respectively.

Figure 5:
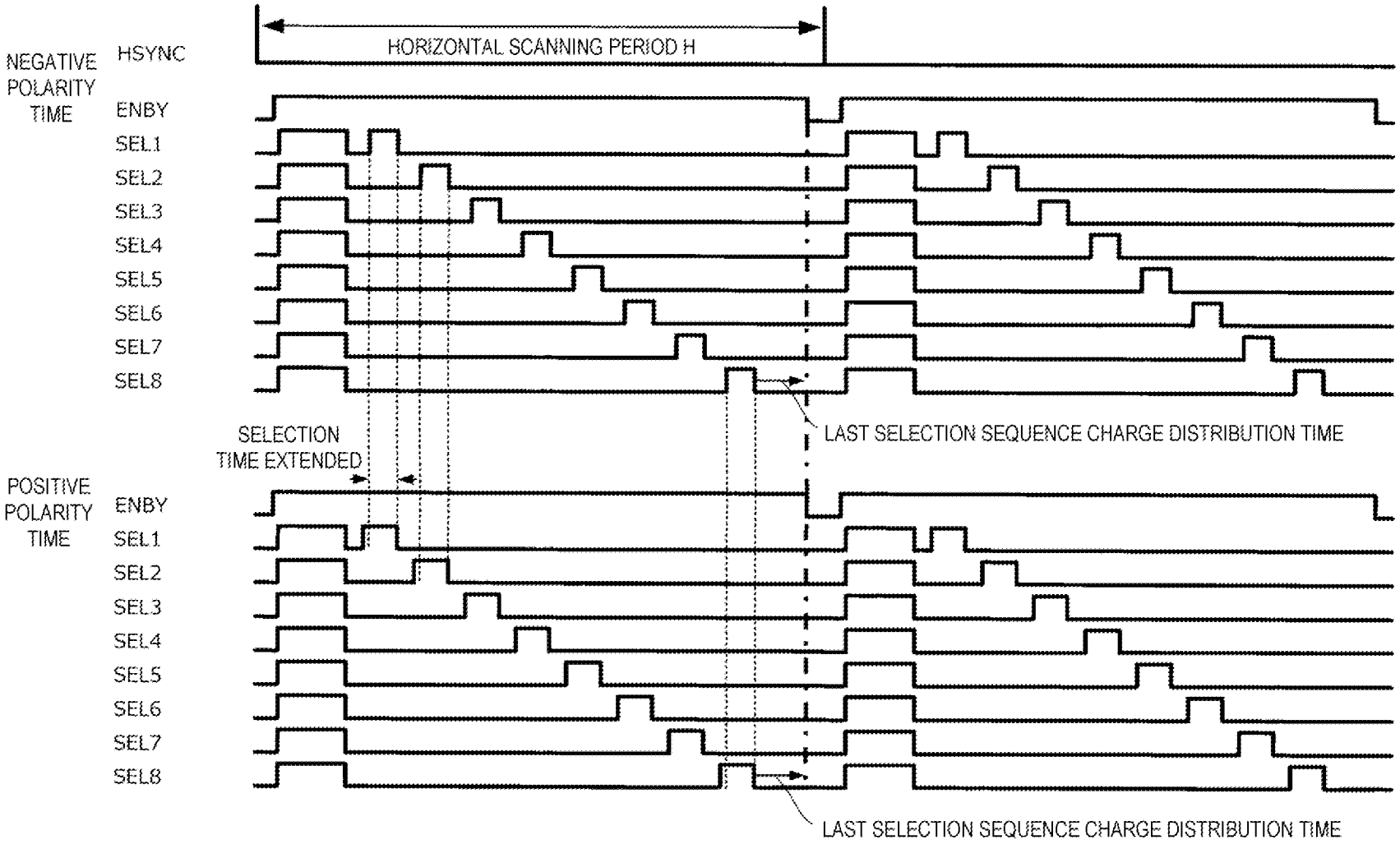
FIG. 5 is an explanatory diagram of an operational example of a control circuit.

FIG. 5 is an explanatory diagram of operation of the control circuit 280 in a horizontal scanning period H. To describe in more detail, FIG. 5 is a diagram in which waveforms of the respective selection signals SEL1 to SEL8 in the horizontal scanning period H are merged for each polarity of an image signal. Note that, a signal HSYNC in FIG. 5 is a horizontal synchronization signal. Furthermore, FIG. 5 illustrates a waveform at a site where bluntness of a waveform of each of the selection signals SEL1 to SEL8 is maximized, specifically, at a site farther from an input terminal of each of the selection signal SEL1 to SEL8. As illustrated in FIG. 5, the control circuit 280 selects each sequence in an order of the first sequence, a second sequence, . . . , a seventh sequence, and an eighth sequence at both of the negative polarity time and the positive polarity time. Further, the control circuit 280 controls rising timing of the selection signals SEL1 to SEL8 such that, for each sequence of the first sequence, the second sequence, . . . , the seventh sequence, and the eighth sequence, start timing of a supply period at the positive polarity time is earlier than the start timing of a supply period at the negative polarity time. In addition, the control circuit 280 controls falling timing of the selection signals SEL1 to SEL8 such that end timing of the respective supply period is the same at the negative polarity time and at the positive polarity time for each sequence of the first sequence, the second sequence, . . . , the seventh sequence, and the eighth sequence. As a result, in the present exemplary embodiment, a time length of the supply period at the positive polarity time for each sequence of the first sequence, the second sequence, . . . , the seventh sequence, and the eighth sequence is longer than a time length of the supply period at the negative polarity time.

Figure 6:
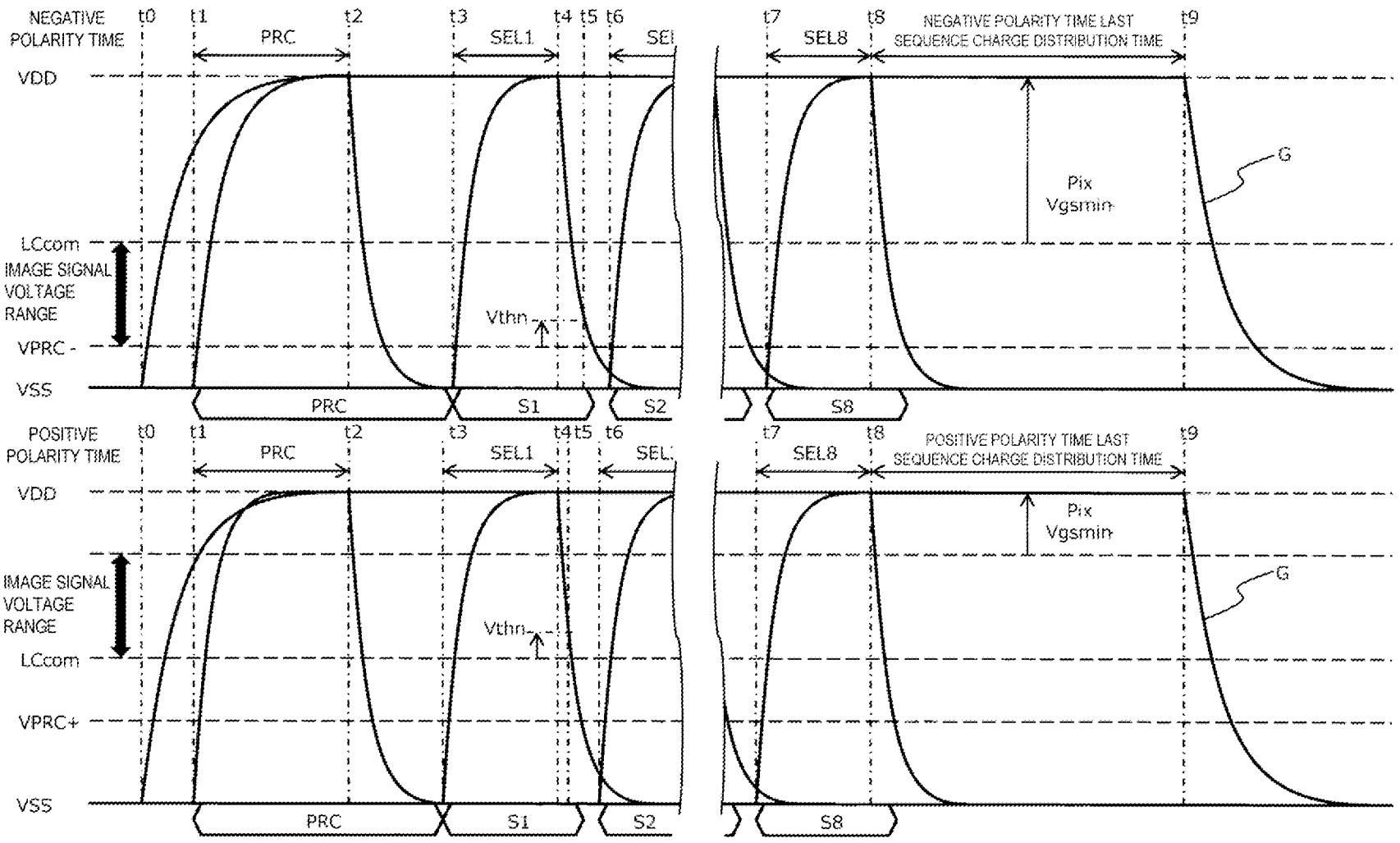
FIG. 6 is a diagram illustrating operation timing of a first horizontal scanning period.

FIG. 6 is a diagram illustrating operation timing in the horizontal scanning period H. Note that, in the drawing, VDD is 15.5V, and is selective potential of the scanning line 120. VSS is ground potential and is non-selective potential of the scanning line 120. In addition, in the following description, for convenience, a push down voltage by the pixel transistor TRh is set to zero, and adjustment of an optimal common voltage is also zero. A time t0 in FIG. 6 is a selection start time of the scanning line 120 in the horizontal scanning period H, and a time t1 is a start time of pre-charge. In the present exemplary embodiment, all the selection signals SEL1 to 8 in all the first to eighth sequences are set to the selective potential and the pre-charge to the signal line 122 in each sequence is performed. A time t2 in FIG. 6 is an end time of the pre-charge, and is a time at which the selection signals SEL1 to SEL8 are all set to the non-selective potential such as a low level.

A time t3 in FIG. 6 is a start time of transition to a selected state for the first sequence, and a time t4 is a start time of transition to a non-selected state for the first sequence. In other words, in a period from the time t3 to the time t4, the selection signal SEL1 is set to the selective potential, and the selection signals SEL2 to SEL8 are set to the non-selective potential.

A time t5 in FIG. 6 is a time at which a gate voltage of the write switch SWv1 in the selected state for writing to the signal line 122 in the first sequence is set to a lower limit of a voltage of an image signal+a threshold voltage Vthn. In other words, the time t5 is a time at which the write switch SWv1 in the selected state may be considered to be effectively off. This point will be described below in detail.

At the negative polarity time, the lower limit of the voltage of the image signal≤the pre-charge voltage<an upper limit of the voltage of the image signal. Since potential of the signal line 122 after the pre-charge is the pre-charge voltage, the write switch SWv1 is switched off at a time when a gate voltage of the write switch SWv1 becomes the pre-charge voltage+the threshold voltage Vthn of the write switch SWv1. Since the potential of the signal line 122 after writing of the image signal is equal to or greater than the lower limit of the voltage of the image signal, the write switch SWv1 is switched off regardless of the voltage of the image signal, at a time when the gate voltage of the write switch SWv1 is the lower limit of the voltage of the image signal+the threshold voltage Vthn of the write switch SWv1. In the present exemplary embodiment, as illustrated in FIG. 6, the lower limit of the voltage of the image signal at the negative polarity time is equal to the pre-charge voltage, and the write switch SWv1 is switched off at the time when the gate voltage of the write switch SWv1 becomes the pre-charge voltage+the threshold voltage Vthn of the write switch SWv1.

On the other hand, at the positive polarity time, the pre-charge voltage<the lower limit of the voltage of the image signal. Since potential of the signal line 122 after the pre-charge is the pre-charge voltage, the write switch SWv1 is switched off at a time when a gate voltage of the write switch SWv1 becomes the pre-charge voltage+the threshold voltage Vthn of the write switch SWv1. Since the potential of the signal line 122 after writing of the image signal is equal to or greater than the lower limit of the voltage of the image signal, the write switch SWv1 is switched off regardless of the voltage of the image signal, at a time when the gate voltage of the write switch SWv1 is the lower limit of the voltage of the image signal+the threshold voltage Vthn of the write switch SWv1. As illustrated in FIG. 6, a period from a time t4 to a time t5 at the positive polarity time is shorter than the period from the time t4 to the time t5 at the negative polarity time.

A time t6 in FIG. 6 is a start time of transition to the selected state for the second sequence. Although detailed illustration is omitted in FIG. 6, after that, the signal lines 122 are written from the third sequence to the seventh sequence. A time t7 in FIG. 6 is a write start time of the image signal to the eighth sequence, and a time t8 is a write end time of the image signal to the eighth sequence. Then, a time t9 in FIG. 6 is an end time of selection of the scanning line.

As described above, in the present exemplary embodiment, the pre-charge voltage VPCG+ at the positive polarity time is higher than the pre-charge voltage VPCG− at the negative polarity time, and as illustrated in FIG. 6, a time length from the time t4 to the time t5 at the positive polarity time is shorter than a time length from the time t4 to the time t5 at the negative polarity time. Thus, a period from the time t4 to the time t6 at the positive polarity time, that is, an interval period between a supply period of the image signal to the first sequence and a supply period of the image signal to the second sequence, can be shorter than an interval period corresponding at the negative polarity time. The interval period refers to, for example, an interval between two continuous supply periods such as an interval between a supply period for the first sequence and a supply period for the second sequence. In the present exemplary embodiment, the fact that the time length from the time t4 to the time t5 at the positive polarity time is shorter than the time length from the time t4 to the time t5 at the negative polarity time is utilized to make the interval period at the positive polarity time shorter than the interval period at the negative polarity time, and make the time length of the supply period at the positive polarity time longer than the time length of the supply period at negative polarity time for each sequence. The control circuit 280 is driven with a high frequency base clock signal. A supply period, an interval period, and the like of each sequence are set based on the base clock signal. For example, a standard supply period of each sequence is defined as a length of 15 clock periods, and a standard length of an interval period is defined as a length of 4 clock periods. In the present exemplary embodiment, for example, the length of the interval period is defined as 4 clock periods at the negative polarity time, and the length is defined as 3 clock periods at the positive polarity time. On the other hand, the length of the interval period is defined as 15 clock periods at the negative polarity time, and the length is defined as 16 clock periods at the positive polarity time.

As illustrated in FIG. 6, the reason why start timing of a supply period of each sequence at the positive polarity time for a first selection sequence is made earlier than start timing of a supply period of each sequence at the negative polarity time, is to set end timing of respective supply periods of the eighth sequence, which is the last selection sequence, to be the same both at the positive polarity time and the negative polarity time, and to suppress occurrence of an insufficient charge distribution time at the positive polarity time for the last selection sequence. Note that, the charge distribution time refers to a distribution time of charged charges of the signal line 122 in the last selection sequence to the pixel circuit PX. Write start timing of the first selection sequence can be preponed, because a time at which the write switch SWv1 is turned off after pre-charge is earlier at the positive polarity time than at the negative polarity time due to a difference in pre-charge voltage. In the present exemplary embodiment, a start time of the supply period of the first selection sequence at the positive polarity time is made earlier than at the negative polarity time by 1 clock period.

According to the present exemplary embodiment, the time length of the supply period at the positive polarity time in each of the first to eighth sequences is made longer than the time length of the supply period at the negative polarity time, thus occurrence of insufficient writing of an image signal to the signal line 122 at the positive polarity time can be avoided, and occurrence of display unevenness can be avoided. In addition, even when the writing time of each sequence at the positive polarity time is increased, by making the start timing of the supply period of each sequence at the positive polarity time earlier compared to the start timing at the negative polarity time, the charge distribution time of the last selection sequence can be set to the same at the positive polarity time and at the negative polarity time.

Second Exemplary Embodiment

Figure 7:
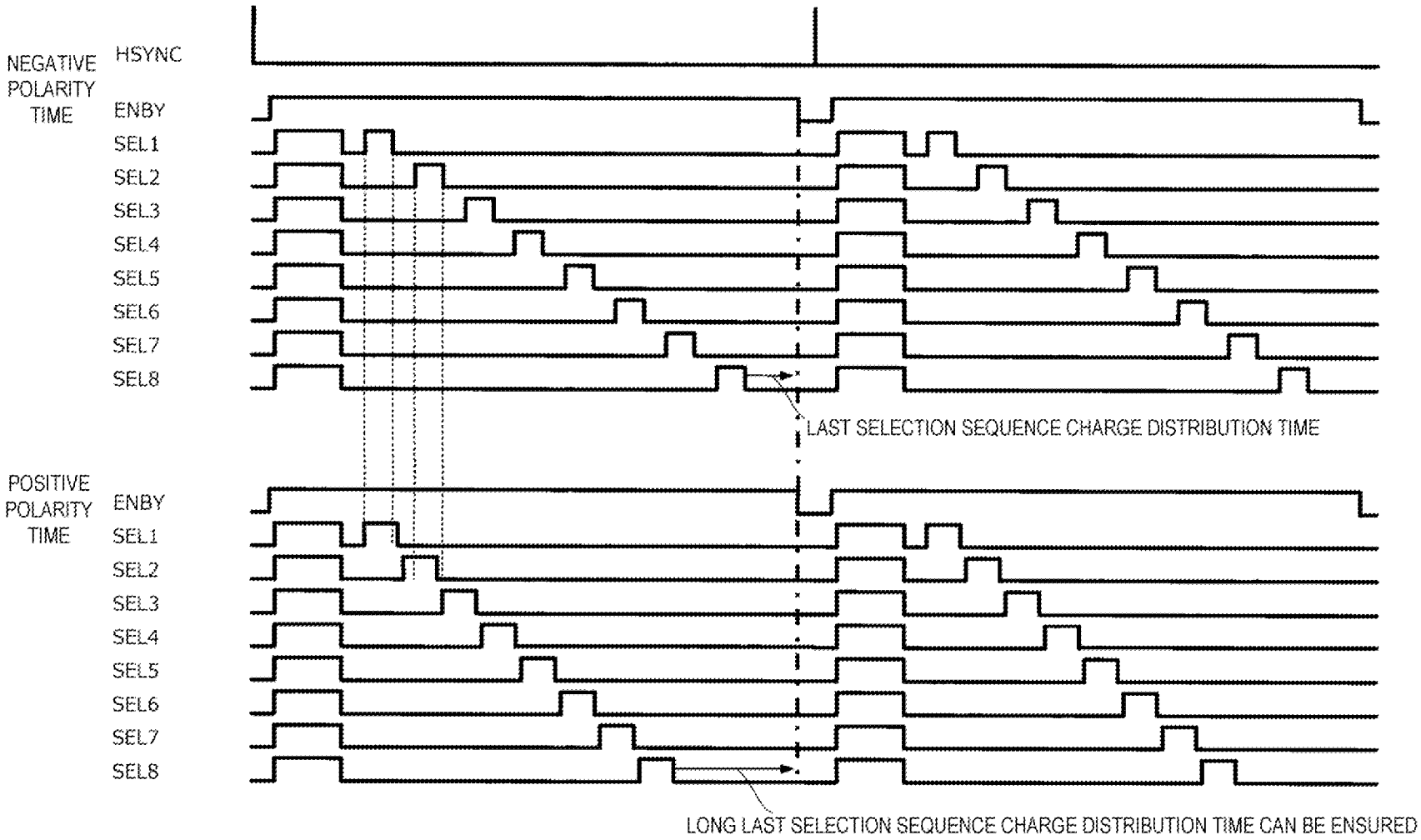
FIG. 7 is an explanatory diagram of an operational example of a control circuit in an electro-optical device according to a second exemplary embodiment of the present disclosure.
Figure 8:
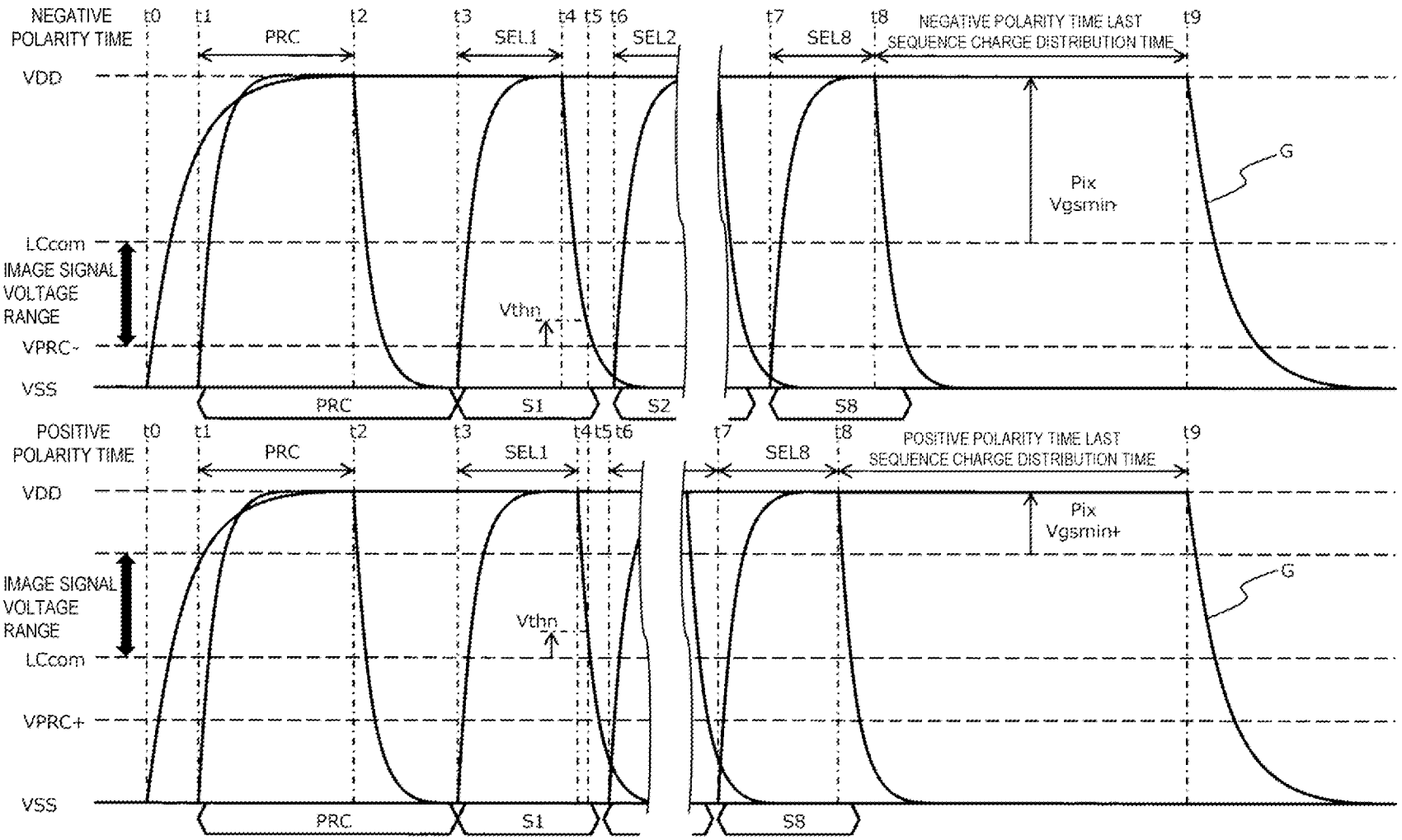
FIG. 8 is a diagram illustrating operation timing of a first horizontal scanning period in the second exemplary embodiment of the present disclosure.

FIG. 7 is an explanatory diagram of an operational example of the control circuit 280 in an electro-optical device according to a second exemplary embodiment of the present disclosure, and FIG. 8 is a diagram illustrating operational timing in the electro-optical device. Note that, a configuration of the electro-optical device of the present exemplary embodiment is identical to the configuration of the electro-optical device 1 of the first exemplary embodiment, and thus detailed description thereof will be omitted. In the present exemplary embodiment too, the control circuit 280 controls rising timing and falling timing of the selection signals SEL1 to SEL8 such that a time length of a supply period at a positive polarity time for each sequence of first to eighth sequences is longer than a time length of a supply period at a negative polarity time. However, in the present exemplary embodiment, as illustrated in FIG. 7 and FIG. 8, the control circuit 280 controls the rising timing of the selection signals SEL1 to SEL8 such that start timing of respective supply periods is the same at the positive polarity time and at the negative polarity time for the first sequence, and start timing is earlier in the supply period at the positive polarity time than in the supply period at the negative polarity time for the second to eighth sequences. Furthermore, the control circuit 280 controls the falling timing of the selection signals SEL1 to SEL8 such that end timing of the supply period of each sequence at the positive polarity time is earlier than end timing of the supply period of each sequence at the negative polarity time. As is clear from a comparison of FIG. 7 and FIG. 5, in the present exemplary embodiment, an interval period between the respective sequences at the positive polarity time is shorter than an interval period between the respective sequences at the positive polarity time in the first exemplary embodiment.

In the present exemplary embodiment, the reason why the interval period between the respective sequences at the positive polarity time can be shortened compared to the first exemplary embodiment is as follows. Increasing the supply period of each sequence at the positive polarity may cause a margin in writing to each sequence at the positive polarity time, and writing capability of the write switch SWv, in other words, a channel width of the write switch SWv can be reduced. For example, when the channel width of the write switch SWv in the first exemplary embodiment is 400 μm in the same manner as a channel width of a write switch in an electro-optical device in the past in which polarity inversion driving is performed, the channel width of the write switch SWv is reduced to 380 μm in the present exemplary embodiment. When the channel width of the write switch SWv is reduced, gate capacity of the write switch SWv that occupies a large portion of a drive load of the image signal circuit 140 is reduced, so a response time is shortened and speed is increased. As a result, the interval period of each sequence at the positive polarity time can be made smaller compared to the first exemplary embodiment, and as a result, the write end time t8 of a last selection sequence for the signal line 122 can be preponed. In the present exemplary embodiment, for example, a length of the interval period is defined as 4 clock periods at the negative polarity time, and the length is defined as 2 clock periods at the positive polarity time. On the other hand, a length of the supply period of each sequence is 15 clock periods at the negative polarity time, and a length of the supply period is 16 clock periods at the positive polarity time. That is, at the positive polarity time, the interval period is shortened by 2 clocks compared to the negative polarity time. On the other hand, the supply period of each sequence at the positive polarity time is extended by 1 clock period compared to the negative polarity time. Therefore, a charge distribution time of the last selection sequence at the positive polarity time is increased by 7 clock periods compared to the negative polarity time. In other words, the write end time t8 of the last selection sequence at the positive polarity time is preponed compared to the negative polarity time.

The following effects are achieved by preponing the write end time t8 of the last selection sequence with respect to the signal line 122. As illustrated in FIG. 8, a voltage range of an image signal at the positive polarity time is located on a high potential side of a voltage range of an image signal at the negative polarity time. Specifically, the voltage range of the image signal at the positive polarity time is from 7 to 12V, and the voltage range of the image signal at the negative polarity time is from 2 to 7V. The voltage range of the image signal at the positive polarity time is located on the high potential side of the voltage range of the image signal at the negative polarity time, thus when a minimum gate voltage of the pixel transistor TRh at the positive polarity time is PixVgsmin+, and a minimum gate voltage of the pixel transistor TRh at the negative polarity time is PixVgsmin−, a size relationship between the two is PixVgsmin+<PixVgsmin−. Since the minimum gate voltage at the positive polarity time becomes smaller than the minimum gate voltage at the negative polarity time, ability to distribute charged charges of the signal line 122 into the pixel circuits PX at the positive polarity time becomes smaller than that at the negative polarity time. According to the present exemplary embodiment, the charge distribution time of the last selection sequence at the positive polarity time can be made longer than a charge distribution time of the last selection sequence at the negative polarity time, thus a reduction in charge distribution capacity at the positive polarity time can be supplemented by an increase in charge distribution time, and high-quality display is enabled. In addition, according to the present exemplary embodiment, a circuit size of the image signal circuit 140 is decreased, and a smaller light valve can be realized than in the first exemplary embodiment because the write switch SWv can be made smaller than in the first exemplary embodiment.

MODIFICATION EXAMPLE

Each of the exemplary embodiments exemplified in the above can be variously modified. Specific modification modes are exemplified below. Two or more modes freely selected from exemplifications below can be appropriately used in combination as long as mutual contradiction does not arise.

Modification Example 1

Figure 9:
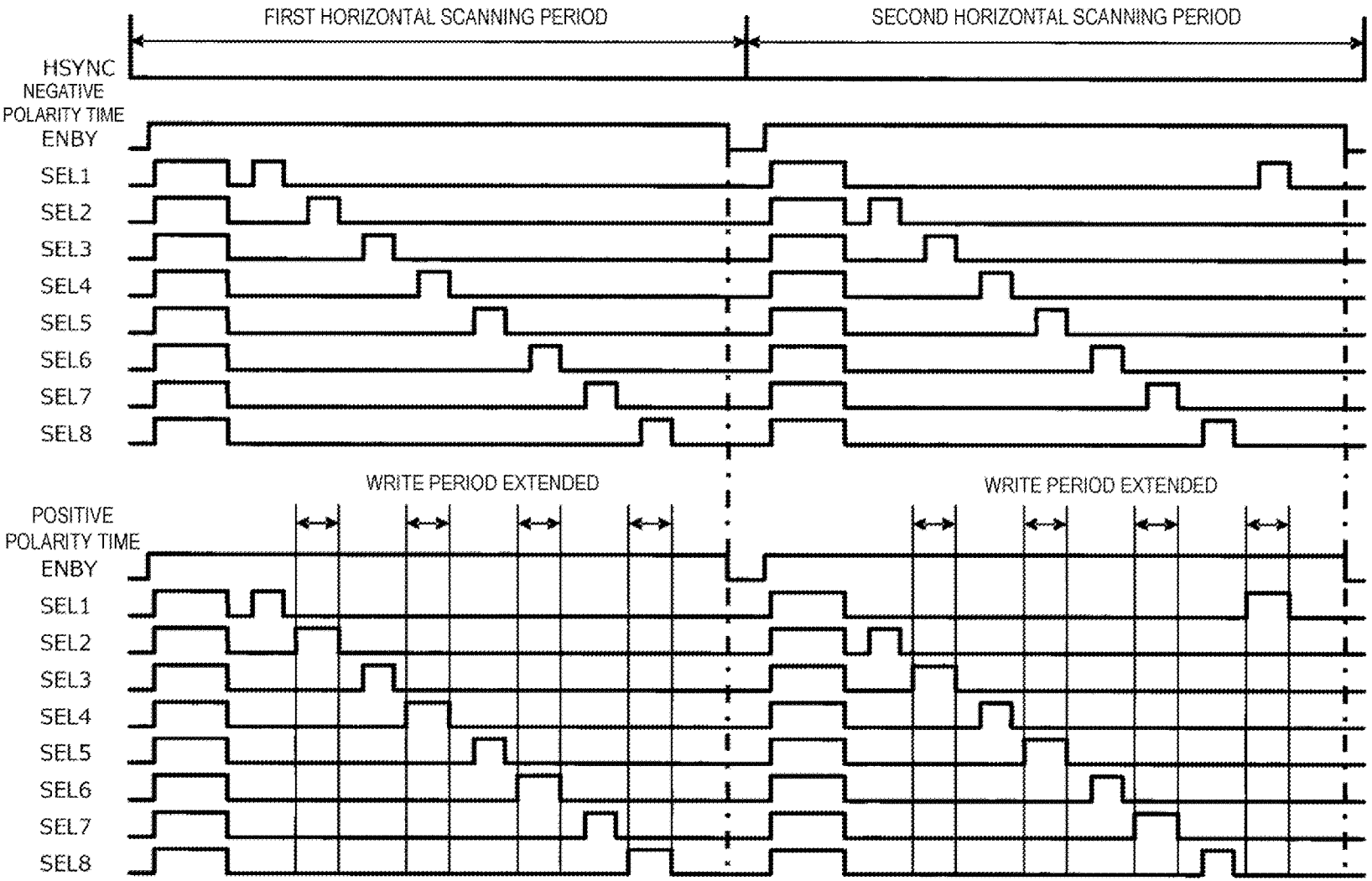
FIG. 9 is a diagram illustrating operation timing of a first horizontal period and a second horizontal period in Modification Example 1.
Figure 10:
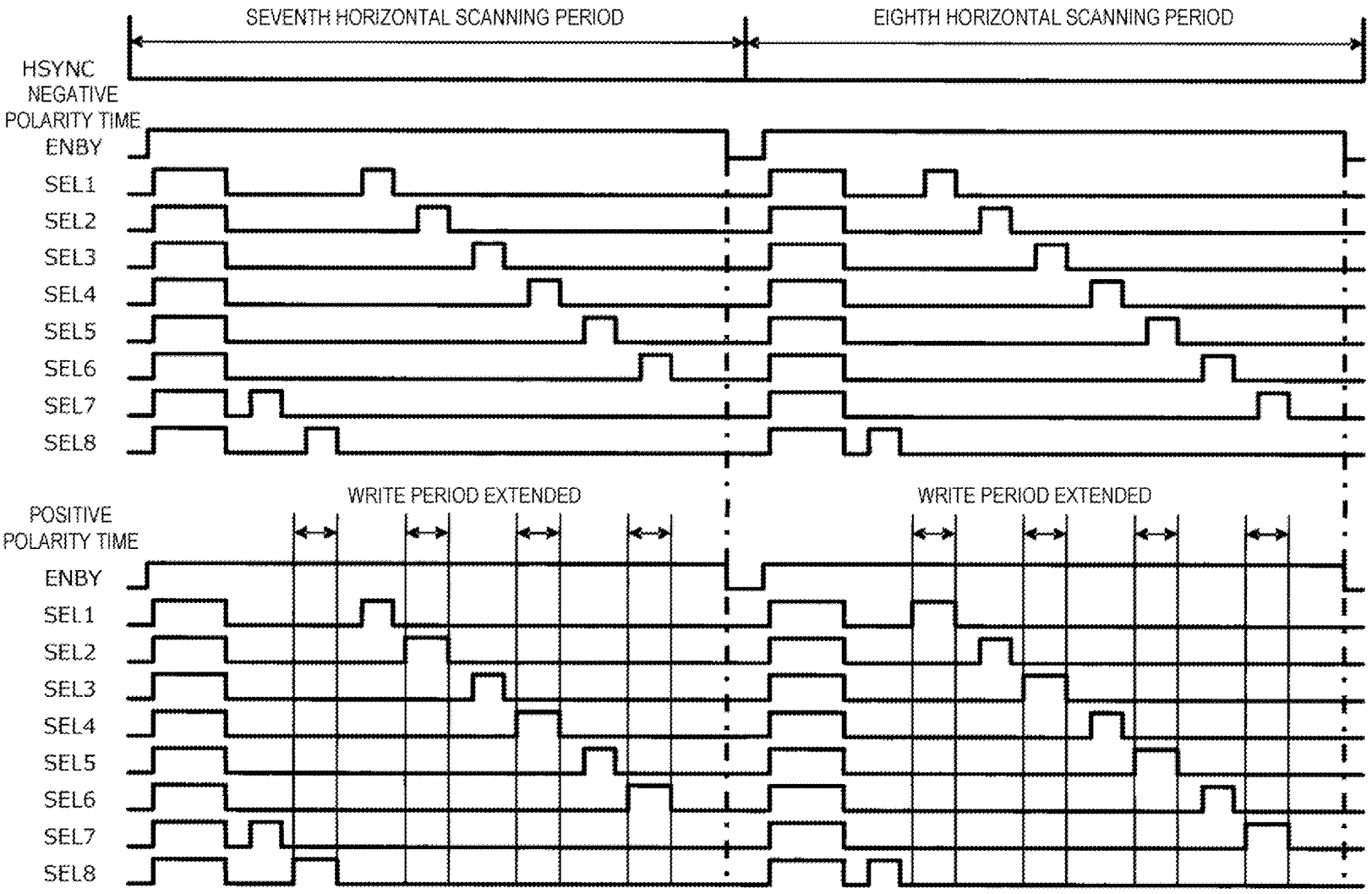
FIG. 10 is a diagram illustrating operation timing of a seventh horizontal period and an eighth horizontal period in Modification Example 1.

In each of the above-described exemplary embodiments, the supply period at the positive polarity time is made longer than the supply period at the negative polarity time for all the sequences of the first to eighth sequences. However, a supply period at the positive polarity time may be longer than a supply period at the negative polarity time for at least one sequence. Note that, a sequence for which a supply period at the positive polarity time is made longer than a supply period at the negative polarity time may be changed per one line or per frame to perform a so-called rotation operation. For example, as illustrated in FIG. 9 and FIG. 10, a first sequence, a second sequence, a third sequence, and a fourth sequence are selected in a first horizontal scanning period, and then a fifth sequence, a sixth sequence, a seventh sequence, and an eighth sequence are selected in that order. Here, for example, a supply period in an even-numbered'th selected sequence among eight supply periods is increased.

Figure 11:
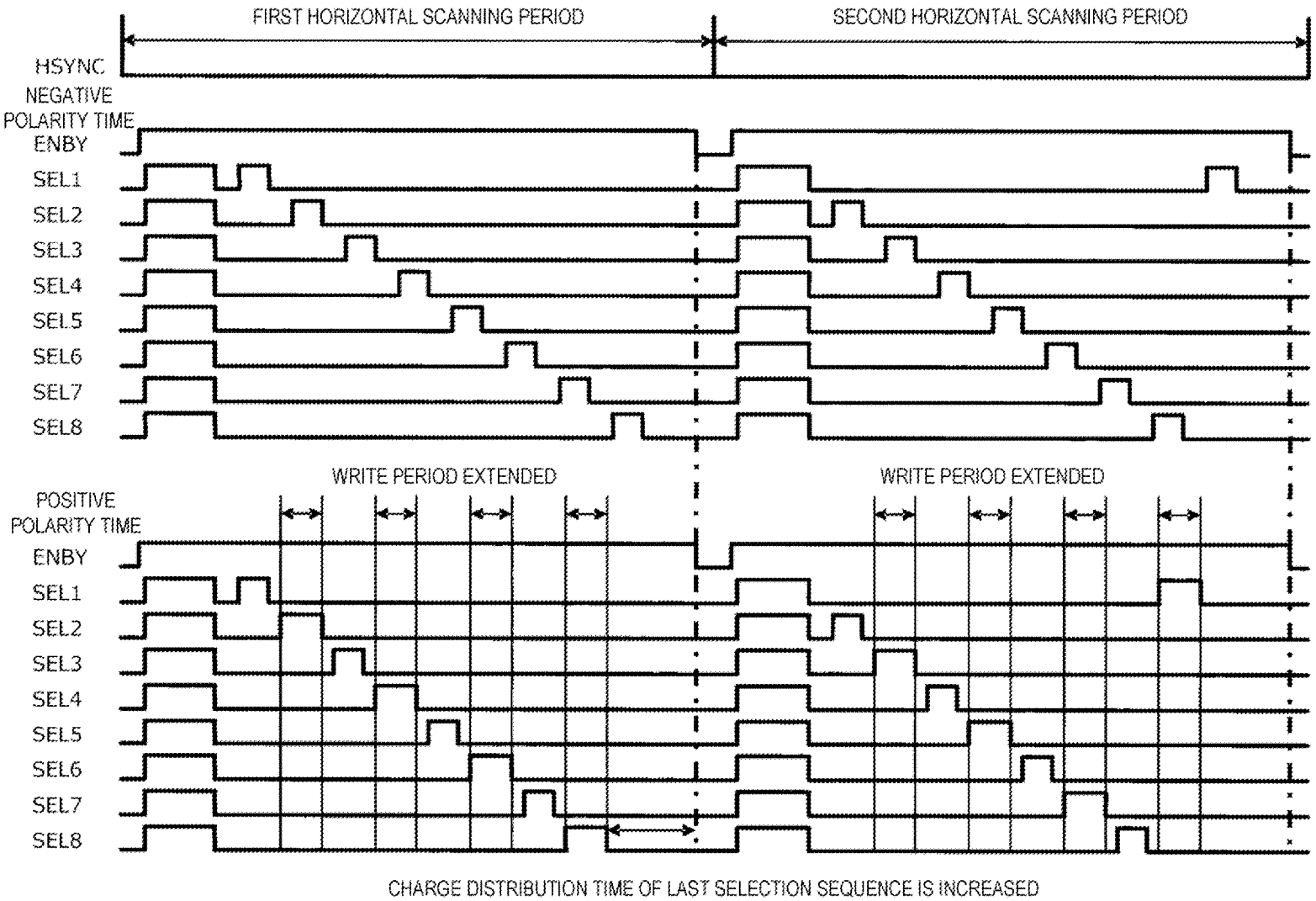
FIG. 11 is a diagram illustrating operation timing of a first horizontal period and a second horizontal period in another exemplary embodiment of Modification Example 1.

At the same time, an odd-numbered'th interval among seven interval periods is shortened. In a second horizontal scanning period, the second sequence, the third sequence, the fourth sequence, and the fifth sequence are selected, and then the sixth sequence, the seventh sequence, the eighth sequence, and the first sequence are selected in that order. Again, the supply period in the even-numbered'th selected sequence among the eight supply periods is increased. At the same time, the odd-numbered'th among the seven interval periods is shortened. Driving is performed in this manner, while shifting the sequences, the seventh sequence, the eighth sequence, the first sequence, and the second sequence are selected in a seventh horizontal scanning period, and then the third sequence, the fourth sequence, the fifth sequence, and the sixth sequence are selected in that order. Again, the supply period in the even-numbered'th selected sequence among the eight supply periods is increased. At the same time, the odd-numbered'th among the seven interval periods is shortened. In an eighth horizontal scanning period, the eighth sequence, the first sequence, the second sequence, and the third sequence are selected, and then the fourth sequence, the fifth sequence, the sixth sequence, and the seventh sequence are selected in that order. Again, the supply period in the even-numbered'th selected sequence among the eight supply periods is increased. At the same time, an odd-numbered'th interval among seven interval periods is shortened. By driving the pixel circuits in the eight rows in this way, the rotation is performed once. In the first exemplary embodiment, the number of rows of pixels is 2160, and thus, the rotation is performed 270 times in one frame. At this time, only the first horizontal period and the second horizontal period are illustrated in FIG. 11, but of course, all the seven interval periods may be shortened.

In the above-described modification example, in the first horizontal period, the time length of the supply period of each of the second sequence, the fourth sequence, the sixth sequence, and the eighth sequence is made longer than the time length of the supply period of each of the first sequence, the third sequence, the fifth sequence, and the seventh sequence, but the time length of the supply period of each of the first sequence, the third sequence, the fifth sequence, and the seventh sequence may be longer than the time length of the supply period of each of the second sequence, the fourth sequence, the sixth sequence, and the eighth sequence. In addition, a size relationship of the supply periods may be changed per one horizontal period or per frame. When one pixel row is viewed, the number of sequences for which writing to the signal line 122 is improved is halved, but pixels for which an effect by extending the supply period due to the rotation of the size relationship of the supply periods is obtained are averaged over time, and an image for which insufficient writing is improved in comparison to the past can be displayed.

Modification Example 2

JP 2018-92140 discloses a configuration in which pre-charge timing is changed in accordance with a polarity of an image signal, and the configuration may be combined with each of the above-described exemplary embodiments.

Modification Example 3

Each of the exemplary embodiments described above has exemplified the device using the liquid crystals as the electro-optical device, however, the present disclosure is not limited thereto. Specifically, it is sufficient to use an electro-optical device using an electro-optical material that changes optical characteristics depending on electric energy. Note that the electro-optical material refers to a material that changes optical characteristics, such as transmittance and luminance, depending on the supply of an electric signal, such as an electric current signal or a voltage signal. For example, the present disclosure can also be applied to a display panel using light-emitting devices such as organic ElectroLuminescent (EL) devices, inorganic EL devices, and light-emitting polymers, similarly to the first exemplary embodiment and the second exemplary embodiment described above.

Furthermore, the present disclosure can also be applied to an electrophoretic display panel that uses, as the electro-optical material, micro capsules each including colored liquid and white particles distributed in the liquid, similarly to the first exemplary embodiment and the second exemplary embodiment described above. Further, the present disclosure can also be applied to a twisting ball display panel that uses, as the electro-optical material, twisting balls each having different colors painted in areas having different polarities, similarly to the first exemplary embodiment and the second exemplary embodiment described above. The present disclosure can also be applied to various electro-optical devices, such as a toner display panel that uses black toner as the electro-optical material, similarly to the first exemplary embodiment and the second exemplary embodiment described above. In addition, in each of the above-described exemplary embodiments, the pixel transistor TRh and the write switch SWv are of the same N-channel type, but the present disclosure is not limited thereto. For example, when the pixel transistor TRh is of the N channel type and the write switch SWv is of a P-channel type, the write switch SWv can be turned off quickly at a negative polarity time. Therefore, since an interval period can be shortened at the negative polarity time, a supply period at the negative polarity time, that is, a selection time of each sequence at the negative polarity time can be made longer than at a positive polarity time.

Application Examples

Figure 12:
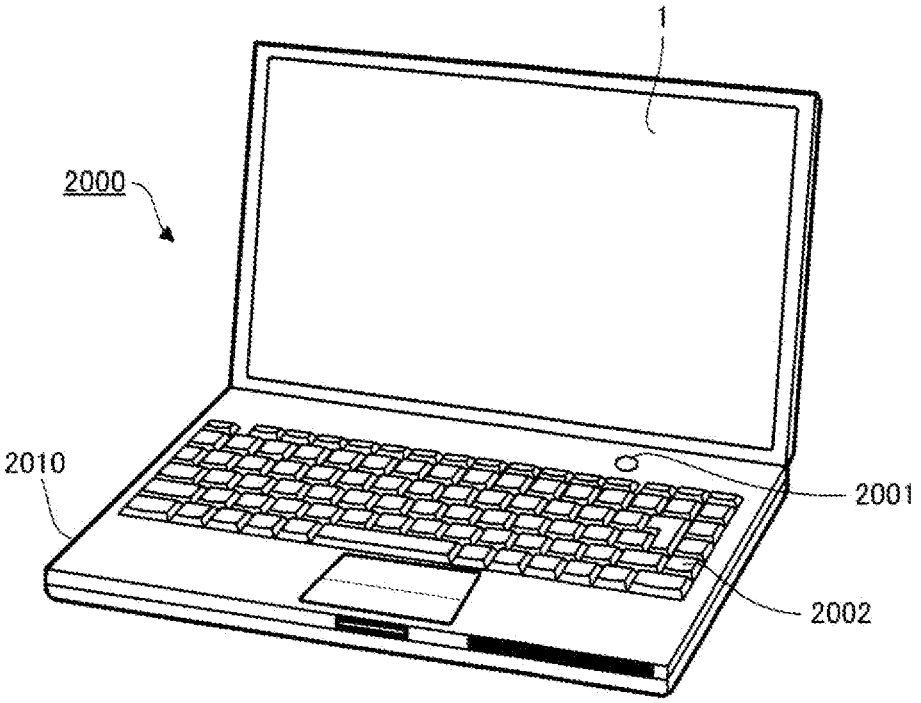
FIG. 12 is an explanatory diagram illustrating an example of electronic apparatuses.
Figure 13:
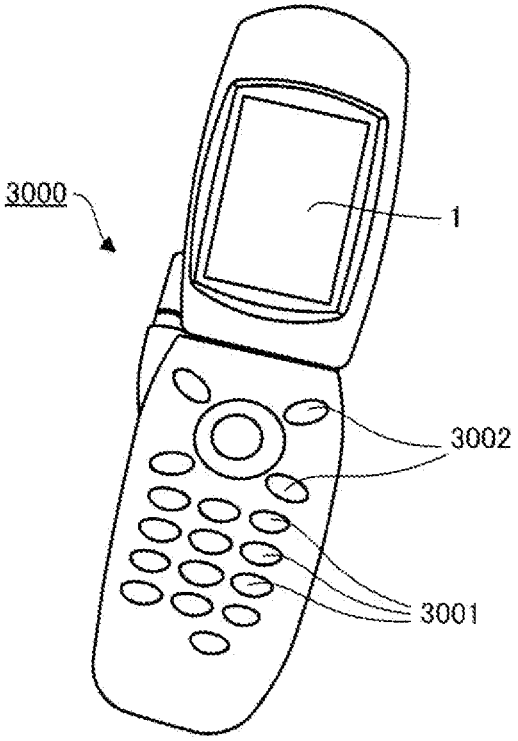
FIG. 13 is an explanatory diagram illustrating another example of the electronic apparatuses.
Figure 14:
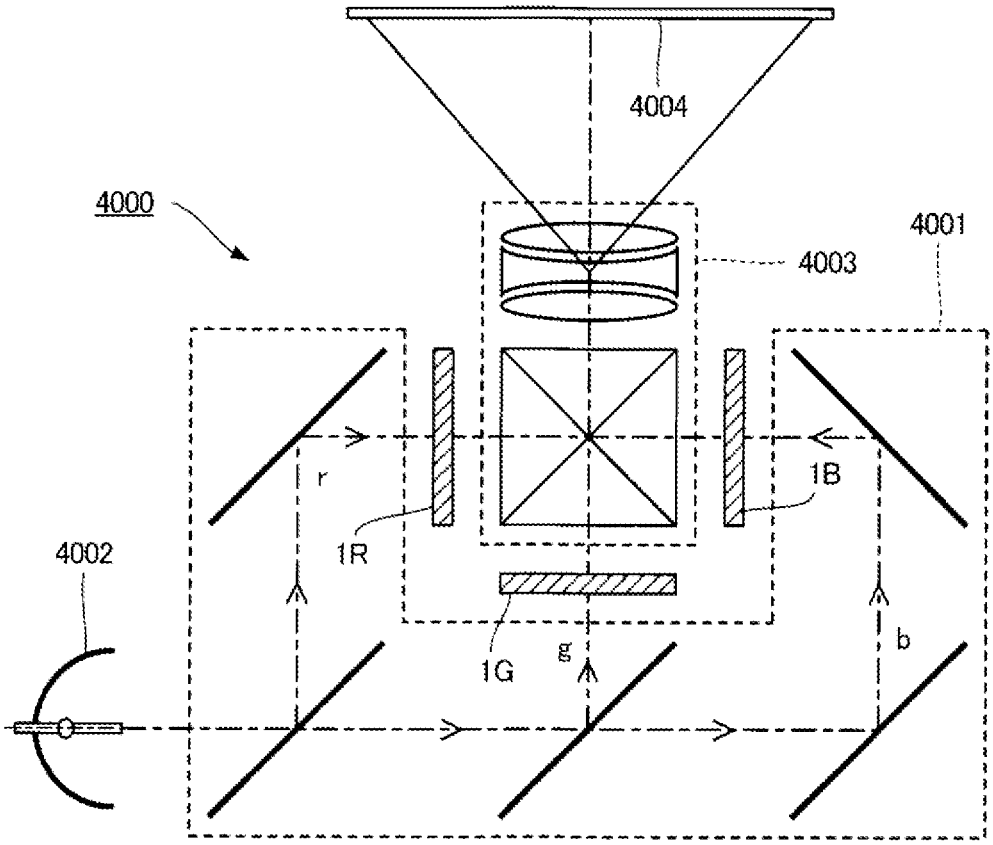
FIG. 14 is an explanatory diagram illustrating another example of the electronic apparatuses.

The present disclosure can be used in various electronic apparatuses. FIG. 12 to FIG. 14 exemplify specific modes of the electronic apparatuses to which the present disclosure is applied.

FIG. 12 is an explanatory diagram illustrating an example of the electronic apparatus. Note that FIG. 12 is a perspective view of a portable personal computer 2000 adopting the electro-optical device 1. The personal computer 2000 includes the electro-optical device 1 configured to display various images, and a main body portion 2010 in which a power source switch 2001 and a keyboard 2002 are installed.

FIG. 13 is an explanatory diagram illustrating another example of the electronic apparatuses. Note that, FIG. 13 is a perspective view of a mobile phone 3000. The mobile phone 3000 includes a plurality of operation buttons 3001 and scroll buttons 3002, and the electro-optical device 1 configured to display various images. Operation of any of the scroll buttons 3002 causes a screen displayed on the electro-optical device 1 to be scrolled.

FIG. 14 is an explanatory diagram illustrating another example of the electronic apparatuses. Note that, FIG. 14 is a schematic view illustrating a configuration of a projection-type display device 4000 adopting the electro-optical device 1. The projection-type display device 4000 is a three-plate type projector, for example. An electro-optical device 1R illustrated in FIG. 14 is the electro-optical device 1 corresponding to a red display color, an electro-optical device 1G is the electro-optical device 1 corresponding to a green display color, and an electro-optical device 1B is the electro-optical device 1 corresponding to a blue display color.

Specifically, the projection-type display device 4000 includes three electro-optical devices 1R, 1G, and 1B that respectively correspond to display colors of red, green, and blue. An illumination optical system 4001 supplies a red element r of light emitted from an illumination device 4002 as a light source to the electro-optical device 1R, a green element g of the light to the electro-optical device 1G, and a blue element b of the light to the electro-optical device 1B. Each of the electro-optical devices 1R, 1G, and 1B functions as an optical modulator, such as a light valve, that modulates respective rays of the monochromatic light supplied from the illumination optical system 4001 depending on display images. A projection optical system 4003 combines the rays of the light emitted from each of the electro-optical devices 1R, 1G, and 1B to project the combined light to a projection surface 4004. Specifically, the present disclosure can also be applied to a liquid crystal projector.

Note that, in addition to the examples of the apparatuses illustrated in FIG. 1 and FIG. 12 to FIG. 14, examples of the electronic apparatuses to which the present disclosure is applied include a Personal Digital Assistant (PDA). Other examples include a digital still camera, a television set, a video camera, a car navigation device, a display device for in-vehicle use such as an instrument panel, an electronic organizer, electronic paper, an electronic calculator, a word processor, a workstation, a visual telephone, and a POS terminal. Other examples further include a device including a printer, a scanner, a copier, a video player, and a touch panel.

Aspects Grasped from at Least One of Exemplary Embodiments and Modification Examples The present disclosure is not limited to the exemplary embodiments and modification examples described above, and may be implemented in various aspects without departing from the spirits of the disclosure. For example, the present disclosure may be achieved through the following aspects. Appropriate replacements or combinations may be made to the technical features in the above-described exemplary embodiments which correspond to the technical features in the aspects described below to solve some or all of the problems of the disclosure or to achieve some or all of the advantageous effects of the disclosure. Additionally, when the technical features are not described herein as essential technical features, such technical features may be deleted appropriately.

An aspect of the electro-optical device of the present disclosure includes a scanning line, K signal lines, a pixel circuit disposed corresponding to each of intersections of the scanning line and the K signal lines, an image signal circuit, and a control circuit. Note that, in the present aspect, K is an integer equal to or greater than 2. The image signal circuit includes a sampling switch provided for each of the K signal lines. The image signal circuit sequentially supplies an image signal to the K signal lines during K supply periods based on K selection signals that sequentially select the K sampling switches in a horizontal scanning period. The control circuit controls the K selection signals such that a length of at least one supply period of the K supply periods in the horizontal scanning period changes in accordance with a polarity of the image signal. According to the present aspect, by adjusting the length of the supply period in accordance with the polarity of the image signal, it is possible to reliably write the image signal to the signal line regardless of the polarity of the image signal, which makes it possible to realize high-quality display.

In an electro-optical device of a more preferred aspect, the sampling switch is an N-channel type transistor, and the at least one supply period when the image signal has a positive polarity may be longer than the at least one supply period when the image signal has a negative polarity. According to the present aspect, occurrence of insufficient writing to the signal line at a positive polarity time can be avoided, and high-quality display can be realized.

Further, an aspect of the electro-optical device of the present disclosure includes a scanning line, K signal lines, a pixel circuit disposed corresponding to each of intersections of the scanning line and the K signal lines, an image signal circuit, and a control circuit. Note that, in the present aspect too, K is an integer equal to or greater than 2. The image signal circuit includes a sampling switch provided for each of the K signal lines. The image signal circuit sequentially supplies an image signal to the K signal lines during K supply periods based on K selection signals that sequentially select the K sampling switches in a horizontal scanning period. The control circuit controls the K selection signals such that start timing of a first supply period of the K supply periods in the horizontal scanning period changes in accordance with a polarity of the image signal. According to the present aspect, adjusting the start timing of the first supply period in accordance with the polarity of the image signal allows the length of the supply period of each sequence to be adjusted according to the polarity of the image signal, or selection end timing of a last selection sequence to be adjusted according to the polarity of the image signal. When the length of the supply period of each sequence is adjusted according to the polarity of the image signal, it is possible to reliably write the image signal to the signal line regardless of the polarity of the image signal, which makes it possible to realize high-quality display. When the selection end timing of the last selection sequence is adjusted according to the polarity of the image signal, a reduction in charge distribution capacity in accordance with the polarity of the image signal is supplemented by adjusting a charge distribution time, and high-quality display can be achieved.

In an electro-optical device of a more preferred aspect, a control circuit may control K selection signals such that end timing of a last supply period of the K supply periods in a horizontal scanning period changes in accordance with a polarity of an image signal. According to the present aspect, a reduction in charge distribution capacity in accordance with a polarity of an image signal is supplemented by adjusting a charge distribution time, and high-quality display can be achieved.

In addition, in an electro-optical device of another preferred aspect, a sampling switch is an N-channel type transistor, and end timing when an image signal has a positive polarity may be earlier than end timing when an image signal has a negative polarity. According to the present aspect, a reduction in charge distribution capacity at a positive polarity time is supplemented by adjusting a charge distribution time, and high-quality display can be achieved.

Additionally, an electronic apparatus of the present disclosure includes the electro-optical device of any of the above-described aspects. Even in the present aspect, high-quality display can be achieved.

What is claimed is:

1. An electro-optical device, comprising:

a scanning line;

K signal lines, K being an integer of 2 or greater;

a pixel circuit disposed corresponding to each of intersections of the scanning line and the K signal lines;

an image signal circuit including a sampling switch provided for each of the K signal lines, and configured to sequentially supply an image signal to the K signal lines, in K supply periods based on K selection signals for sequentially selecting the K sampling switches, in a horizontal scanning period; and a control circuit configured to control the K selection signals such that a length of at least one supply period of the K supply periods in the horizontal scanning period changes in accordance with a polarity of the image signal, wherein the control circuit controls the K selection signals such that end timing of a last supply period of the K supply periods in the horizontal scanning period changes in accordance with a polarity of the image signal.

2. The electro-optical device according to claim 1, wherein the sampling switch is an N-channel type transistor, and at least one supply period when the image signal has a positive polarity is longer than the at least one supply period when the image signal has a negative polarity.

3. An electro-optical device, comprising:

a scanning line;

K signal lines, K being an integer of 2 or greater;

a pixel circuit disposed corresponding to each of intersections of the scanning line and the K signal lines;

an image signal circuit including a sampling switch provided for each of the K signal lines, and configured to sequentially supply an image signal to the K signal lines, in K supply periods based on K selection signals for sequentially selecting the K sampling switches, in a horizontal scanning period; and a control circuit configured to control the K selection signals such that start timing of a first supply period of the K supply periods in the horizontal scanning period changes in accordance with a polarity of the image signal, wherein the sampling switch is an N-channel type transistor, and at least one supply period when the image signal has a positive polarity is longer than the at least one supply period when the image signal has a negative polarity.

4. The electro-optical device according to claim 1, wherein the sampling switch is an N-channel type transistor, and the end timing when the image signal has a positive polarity is earlier than the end timing when the image signal has a negative polarity.

5. An electronic apparatus, comprising:

an electro-optical device, comprising: a main body;

a scanning line; K signal lines, K being an integer of 2 or greater;

a pixel circuit disposed corresponding to each of intersections of the scanning line and the K signal lines; an image signal circuit including a sampling switch provided for each of the K signal lines, and configured to sequentially supply an image signal to the K signal lines, in K supply periods based on K selection signals for sequentially selecting the K sampling switches, in a horizontal scanning period; and a control circuit configured to control the K selection signals such that a length of at least one supply period of the K supply periods in the horizontal scanning period changes in accordance with a polarity of the image signal, wherein the control circuit controls the K selection signals such that end timing of a last supply period of the K supply periods in the horizontal scanning period changes in accordance with a polarity of the image signal.

6. An electro-optical device, comprising:

a scanning line;

K signal lines, K being an integer of 2 or greater;

a pixel circuit disposed corresponding to each of intersections of the scanning line and the K signal lines;

an image signal circuit including a sampling switch provided for each of the K signal lines, and configured to sequentially supply an image signal to the K signal lines, in K supply periods based on K selection signals for sequentially selecting the K sampling switches, in a horizontal scanning period; and a control circuit configured to control the K selection signals such that a length of at least one supply period of the K supply periods in the horizontal scanning period changes in accordance with a polarity of the image signal, wherein the sampling switch is an N-channel type transistor, and at least one supply period when the image signal has a positive polarity is longer than the at least one supply period when the image signal has a negative polarity.

* * * * *